US011559717B2

(12) United States Patent
Breitowich

(10) Patent No.: US 11,559,717 B2
(45) Date of Patent: Jan. 24, 2023

(54) EXERCISE APPARATUS

(71) Applicant: Lee Breitowich, LaPorte, IN (US)

(72) Inventor: Lee Breitowich, LaPorte, IN (US)

( * ) Notice: Subject to any disclaimer, the term of this patent is extended or adjusted under 35 U.S.C. 154(b) by 116 days.

(21) Appl. No.: 17/102,520

(22) Filed: Nov. 24, 2020

(65) Prior Publication Data

US 2021/0154516 A1 May 27, 2021

Related U.S. Application Data

(60) Provisional application No. 62/941,149, filed on Nov. 27, 2019.

(51) Int. Cl.

| | |
|---|---|
| ***A63B 3/00*** | (2006.01) |
| ***A63B 21/00*** | (2006.01) |
| ***A63B 71/04*** | (2006.01) |

(52) U.S. Cl.

CPC ..... *A63B 3/00* (2013.01); *A63B 21/4035* (2015.10); *A63B 71/04* (2013.01)

(58) Field of Classification Search

CPC ..... A63B 3/00; A63B 21/4035; A63B 71/04; A63B 71/023; A63B 2209/00; A63B 2209/02; A63B 2225/09

See application file for complete search history.

(56) References Cited

U.S. PATENT DOCUMENTS

| | | | |
|---|---|---|---|
| 187,477 | A | 2/1877 | Medart et al. |
| 412,772 | A | 10/1889 | Medart et al. |
| 1,142,137 | A | 6/1915 | Bathrick |
| 2,690,789 | A | 10/1954 | Zadrozny |
| 3,384,368 | A | 5/1968 | Fenner et al. |
| 3,486,750 | A | 12/1969 | Krawitz |
| 3,747,233 | A | 7/1973 | Berryman |
| 3,879,033 | A | 4/1975 | Martin |
| 3,896,798 | A | 7/1975 | Simon |
| 4,402,501 | A | 9/1983 | Lohman |
| 4,406,450 | A | 9/1983 | Regan |
| 4,415,150 | A | 11/1983 | Iezza |
| 4,491,314 | A | 1/1985 | Belyavsky et al. |
| 4,555,107 | A | 11/1985 | Otto |

(Continued)

FOREIGN PATENT DOCUMENTS

| | | |
|---|---|---|
| CN | 103893943 | 7/2014 |
| CN | 204910591 | 12/2015 |

(Continued)

*Primary Examiner* — Andrew S Lo

(74) *Attorney, Agent, or Firm* — C. Fred Charpie, III; Ward Law Office LLC

(57) ABSTRACT

An exercise apparatus is provided. The exercise apparatus includes first and second base assemblies, each having a plurality of riser segments. A first rail is connected to and spans the first and second base assemblies. The first rail has a plurality of horizontal segments interspersed with a plurality of vertical segments. A second rail is spaced apart from the first rail and is connected to and spans the first and second base assemblies. The second rail has a plurality of horizontal segments interspersed with a plurality of vertical segments. The horizontal and vertical segments of the second rail correspond to the horizontal and vertical segments of the first rail. Adjacent horizontal segments of each of the first and second rails are vertically spaced apart.

20 Claims, 7 Drawing Sheets

(56) References Cited

U.S. PATENT DOCUMENTS 4,620,612 A * 11/1986 Enoki ..... E04G 3/30 182/113
4,687,194 A 8/1987 Good et al.
5,150,484 A * 9/1992 Whitten, Jr. ..... A47C 19/20 5/9.1
5,720,697 A 2/1998 Winkel
5,924,960 A 7/1999 Cohen
6,168,548 B1 * 1/2001 Fleming ..... A63B 3/00 482/41
6,238,320 B1 * 5/2001 Flanagan ..... A63B 3/00 482/130
6,929,586 B2 8/2005 Johnson
7,713,175 B2 * 5/2010 Monaghan ..... A63H 33/006 482/38
8,585,559 B1 11/2013 Shannon
D713,543 S * 9/2014 Toda ..... D25/38.1
D713,545 S * 9/2014 Toda ..... D25/38.1
8,876,666 B1 11/2014 Palmer et al.
10,252,095 B1 * 4/2019 Carnahan ..... A63B 3/00
2004/0009845 A1 * 1/2004 Johnson ..... A63B 26/003 482/41
2006/0226615 A1 10/2006 Monaghan
2008/0207405 A1 * 8/2008 Jung ..... A63B 3/00 482/38
2014/0287881 A1 * 9/2014 Wallisch ..... A63B 21/068 482/41
2018/0085623 A1 * 3/2018 Flook ..... A63B 21/0557

FOREIGN PATENT DOCUMENTS

CN 105771151 7/2016
GB 2361877 11/2001
KR 20100000113 U * 1/2010
KR 20100004770 U * 5/2010

* cited by examiner

EXERCISE APPARATUS

RELATED APPLICATIONS

This application claims the benefit of U.S. Provisional Patent Application No. 62/941,149, filed Nov. 27, 2019, the disclosure of which is incorporated herein by reference in its entirety.

BACKGROUND

Conventional floor-based gymnastic apparatus can include the non-limiting examples of pommel horses, balance beam, parallel bars, uneven bars, rings and the like.

A conventional parallel bar apparatus includes two parallel, linearly arranged bars that are held parallel to, and elevated above, the floor by a metal supporting framework. The bars are composed of wood or other material, with an outer coating of wood. The supporting framework typically includes vertical members that may be adjustable in order that the height of the two parallel bars above the floor and the distance between the two parallel bars can be set optimally for each gymnast.

It would be advantageous if floor-based exercise apparatus could be developed for improved strength, stamina, flexibility and coordination.

SUMMARY

It should be appreciated that this Summary is provided to introduce a selection of concepts in a simplified form, the concepts being further described below in the Detailed Description. This Summary is not intended to identify key features or essential features of this disclosure, nor it is intended to limit the scope of the exercise apparatus.

The above objects as well as other objects not specifically enumerated are achieved by an exercise apparatus configured for exercises and exercise routines to develop improved strength, stamina, flexibility and coordination of a user. The exercise apparatus includes a first base assembly having a plurality of riser segments and a second base assembly spaced apart from the first base assembly and having a plurality of riser segments. A first rail is connected to and spans the first and second base assemblies. The first rail has a plurality of horizontal segments interspersed with a plurality of vertical segments. A second rail is spaced apart from the first rail and is connected to and spans the first and second base assemblies. The second rail has a plurality of horizontal segments interspersed with a plurality of vertical segments. The horizontal and vertical segments of the second rail correspond to the horizontal and vertical segments of the first rail. Adjacent horizontal segments of each of the first and second rails are vertically spaced apart.

The above objects as well as other objects not specifically enumerated are also by an exercise apparatus configured for exercises and exercise routines to develop improved strength, stamina, flexibility and coordination of a user. The exercise apparatus includes a first base assembly having a plurality of riser segments and a second base assembly spaced apart from the first base assembly and having a plurality of riser segments. A first rail is connected to and spans the first and second base assemblies. The first rail has a plurality of sloped portions interspersed with a plurality of arcuate portions. A second rail is spaced apart from the first rail and is connected to and spans the first and second base assemblies. The second rail has a plurality of sloped portions interspersed with a plurality of arcuate portions.

The above objects as well as other objects not specifically enumerated are also achieved by a method of forming an exercise apparatus for exercises and exercise routines to develop improved strength, stamina, flexibility and coordination of a user. The method includes the steps of forming a first base assembly with a plurality of riser segments, forming a second base assembly spaced apart from the first base assembly and having a plurality of riser segments, forming a first rail with a plurality of horizontal segments interspersed with a plurality of vertical segments, wherein adjacent horizontal segments of the first rail are spaced apart by a vertical distance, connecting the first rail to the first and second base assemblies, forming a second rail with a plurality of horizontal segments interspersed with a plurality of vertical segments, wherein adjacent horizontal segments of the second rail are spaced apart by a vertical distance and connecting the second rail to the first and second base assemblies in a manner such that the horizontal and vertical segments of the second rail correspond to the horizontal and vertical segments of the first rail.

Various objects and advantages of the exercise apparatus will become apparent to those skilled in the art from the following Detailed Description, when read in light of the accompanying drawings.

DETAILED DESCRIPTION

Figure 1:
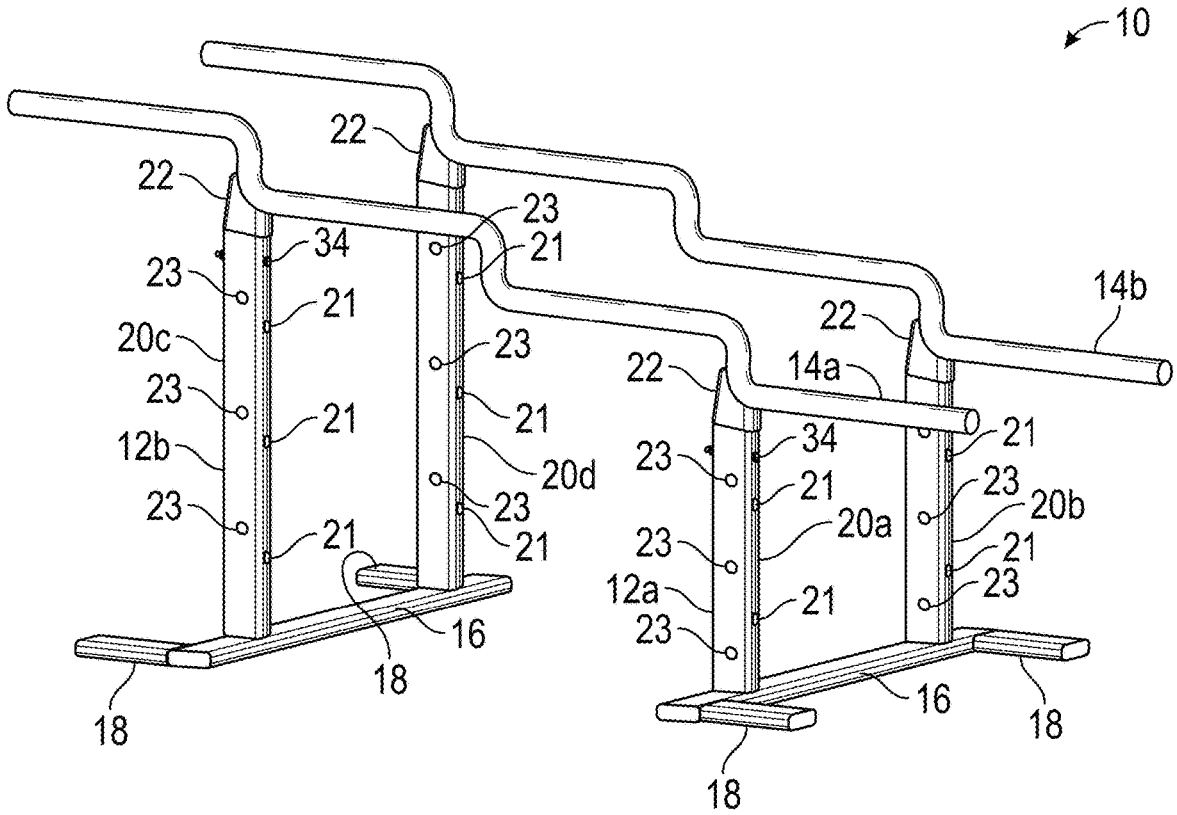
FIG. 1 is a perspective view of an exercise apparatus in accordance with the invention.

The exercise apparatus will now be described with occasional reference to specific embodiments. The exercise apparatus may, however, be embodied in different forms and should not be construed as limited to the embodiments set forth herein. Rather, these embodiments are provided so that this disclosure will be thorough and complete, and will fully convey the scope of the exercise apparatus to those skilled in the art.

Unless otherwise defined, all technical and scientific terms used herein have the same meaning as commonly understood by one of ordinary skill in the art to which the exercise apparatus belongs. The terminology used in the description of the exercise apparatus herein is for describing particular embodiments only and is not intended to be limiting of the exercise apparatus. As used in the description of the exercise apparatus and the appended claims, the singular forms "a," "an," and "the" are intended to include the plural forms as well, unless the context clearly indicates otherwise.

Unless otherwise indicated, all numbers expressing quantities of dimensions such as length, width, height, and so forth as used in the specification and claims are to be understood as being modified in all instances by the term "about." Accordingly, unless otherwise indicated, the numerical properties set forth in the specification and claims are approximations that may vary depending on the desired properties sought to be obtained in embodiments of the exercise apparatus. Notwithstanding that the numerical ranges and parameters setting forth the broad scope of the exercise apparatus are approximations, the numerical values set forth in the specific examples are reported as precisely as possible. Any numerical values, however, inherently contain certain errors necessarily resulting from error found in their respective measurements.

The description and figures disclose an exercise apparatus. The exercise apparatus includes spaced apart rails configured to support a user for exercises and exercise routines to develop improved strength, stamina, flexibility and coordination. In certain embodiments, each of the rails has spaced apart portions that can be arranged in a horizontal, vertical, sloped and/or arcuate orientation.

Referring now to FIGS. 1-5, an exercise apparatus is illustrated generally at 10. The exercise apparatus 10 includes a first base assembly 12*a*, a spaced apart second base assembly 12*b*, a first rail 14*a* and a second rail 14*b*.

Referring again to FIGS. 1-5, the first and second base assemblies 12*a*, 12*b* are configured to support the first and second rails 14*a*, 14*b*. The first and second base assemblies 12*a*, 12*b* are further configured to provide structural stability to the first and second rails 14*a*, 14*b* as the exercise apparatus is used. Each of the first and second base assemblies 12*a*, 12*b* includes a first floor portion 16 and one or more spaced apart second floor portions 18 extending from the first floor portion 16. The first floor portion 16 and the one or more spaced apart second floor portions 18 cooperate to provide structural stability to the first and second rails 14*a*, 14*b* as the exercise apparatus is used. In the illustrated embodiment a quantity of two based assemblies 12, 12*b* are shown. However, in other embodiments, more than two base assemblies can be used sufficient to support the first and second rails 14*a*, 14*b* and provide structural stability to the first and second rails 14*a*, 14*b* as the exercise apparatus is used. In the illustrated embodiment, a quantity of two spaced apart second floor portions 18 are shown extending from the first floor portion 16. In alternate embodiments, more than two second spaced apart floor portions 18 can extend from the first floor portion 16 sufficient to provide structural stability to the first and second rails 14*a*, 14*b* as the exercise apparatus is used.

Referring again to the embodiment shown in FIGS. 1-5, the first and second floor portions 16, 18 are formed from a structural, hollow tubing having a rectangular cross-sectional shape, such as the non-limiting example of A36 metallic tubing having cross-sectional external dimensions of 80.0 mm×30.0 mm and a thickness of 4.1 mm. It should be appreciated that in other embodiments, the first and second floor portions 16, 18 can be formed from other desired materials, such as the non-limiting example of reinforced fiberglass, sufficient to provide structural stability to the first and second rails 14*a*, 14*b* as the exercise apparatus is used.

Referring again to the embodiment shown in FIGS. 1-5, in certain embodiments, a lower surface of the first and second floor portions 16, 18 can be covered with a non-slip material (not shown), configured to secure the exercise apparatus 10 in place as the exercise apparatus is used. Non-limiting examples of suitable non-slip material includes rubber, thermoplastic polymers and the like.

Referring again to the embodiment shown in FIGS. 1-5, first and second floor portions 16, 18 are connected together such that a major face of each of the first and second floor portions 16, 18 is in contact with the floor surface. Without being held to the theory, it is believed that positioning a major face of each of the first and second floor portions 16, 18 in contact with the floor surface provides structural stability to the first and second rails 14*a*, 14*b* as the exercise apparatus is used.

Referring again to the embodiment shown in FIGS. 1-5, the first and second floor portions 16, 18 are connected together by convention welding methods. However, in other embodiments, the first and second floor portions 16, 18 can be connected together by other structures, such as the non-limiting example of brackets, and/or by other methods, such as the non-limiting example adhesives, sonic welding and the like sufficient to provide structural stability to the first and second rails 14*a*, 14*b* as the exercise apparatus is used.

Referring again to FIGS. 1-5, the first base assembly 12*a* includes first and second riser segments 20*a*, 20*b*, each of which extend in a generally vertical direction from opposing ends of the first floor portion 16. The first riser segment 20*a* is configured to support a portion of the rail 14*a*. Similarly, the second riser segment 20*b* is configured to support a portion of the rail 14*b*. The second base assembly 12*b* includes third and fourth riser segments 20*c*, 20*d*, each of which extend in a generally vertical direction from opposing ends of the second floor portion 16. The third riser segment 20*c* is configured to support a portion of the rail 14*a*. Similarly, the fourth riser segment 20*d* is configured to support a portion of the rail 14*b*. In the illustrated embodiment, the riser segments 20*a*-20*d* are formed from the same material as is used to form the first and second floor portions 16, 18. However, in other embodiments, the one or more riser segments 20*a*, 20*b* can be formed from other desired materials.

Figure 2:
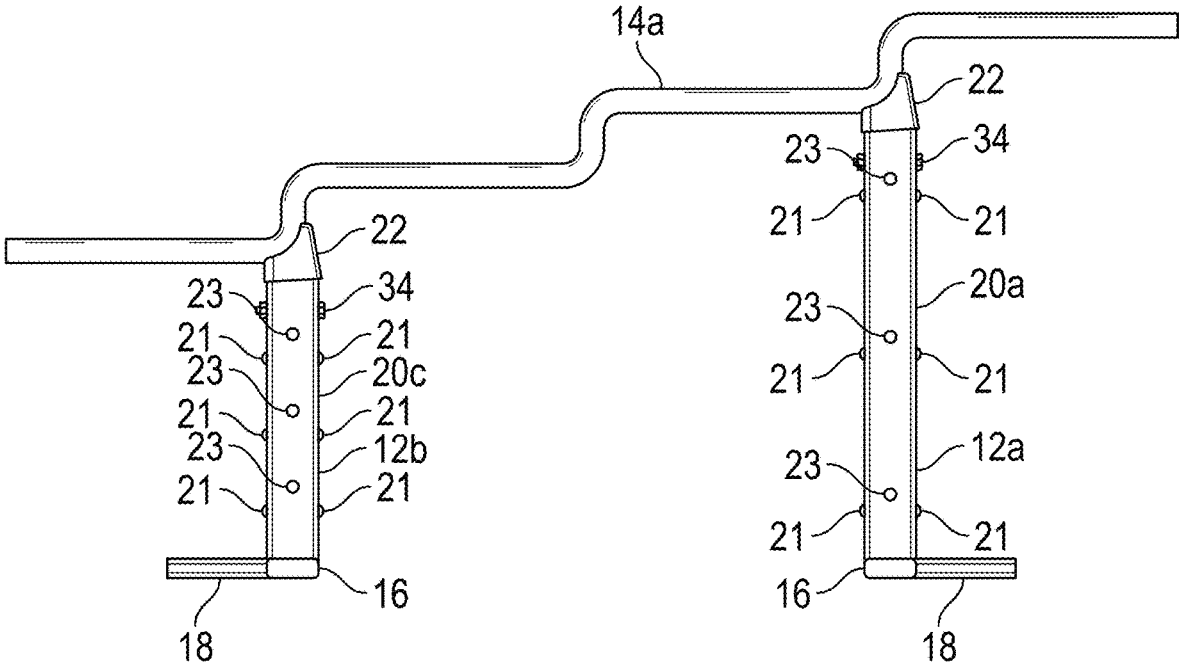
FIG. 2 is a side view of the exercise apparatus of FIG. 1.

Referring now to FIGS. 1 and 2, optionally the riser segments 20*a*-20*d* can include a plurality of spaced apart apertures 21 located in the minor sides. The riser segments 20*a*-20*d* can also include optional spaced apart apertures 23 located in the major sides. The apertures 21, 23 are configured as attachment points for connecting additional exercise related apparatus, including the non-limiting examples of elastic bands and resistance members. However, it should be appreciated that the apertures 21, 23 are optional and not required for successful operation of the exercise apparatus 10.

Figure 6:
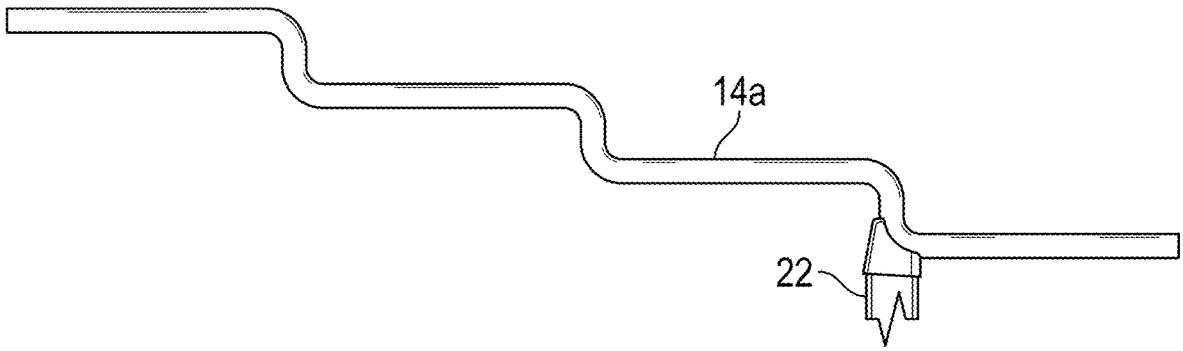
FIG. 6 is a side view of a rail of the exercise apparatus of FIG. 1.
Figure 7:
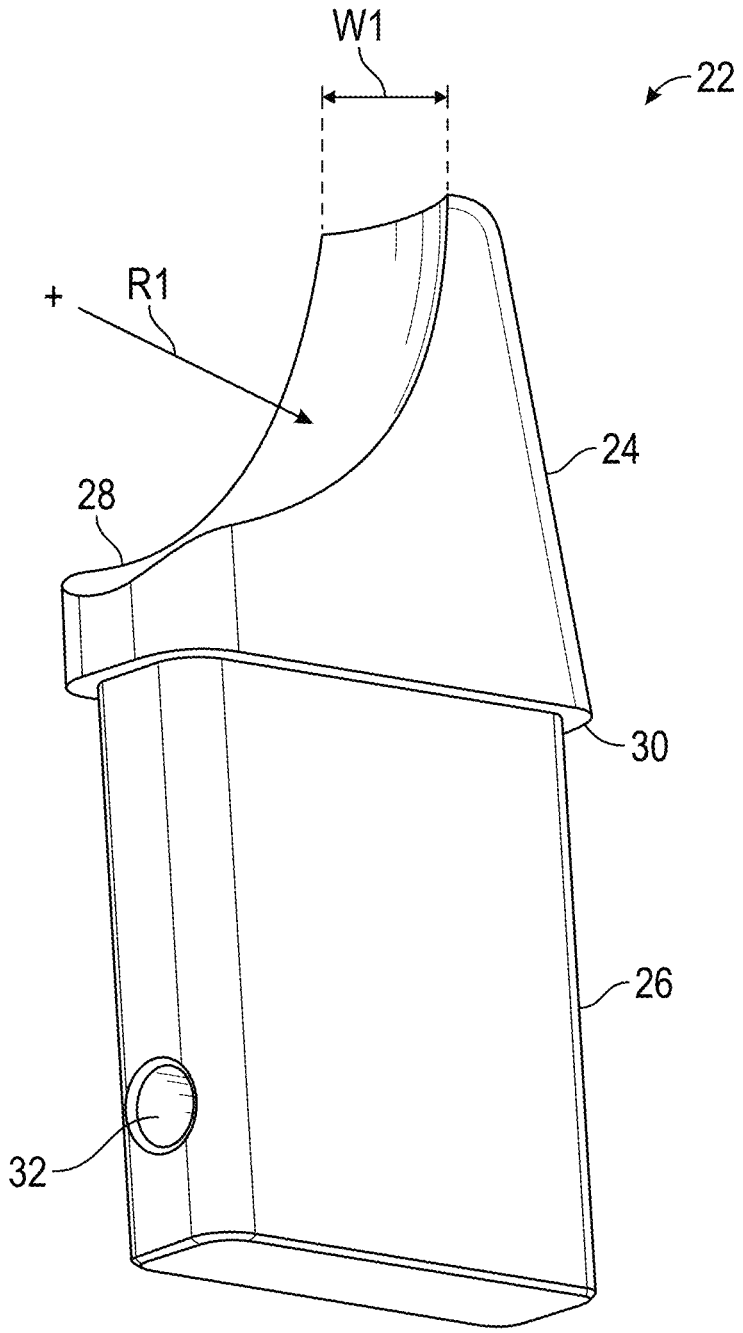
FIG. 7 is a perspective view of a support segment of the exercise apparatus of FIG. 1.

Referring now to FIGS. 1, 2 and 6, a support segment 22 extends from each of the riser segments 20*a*-20*d* and is configured to support an arcuate portion of the rails 14*a*, 14*b*. Referring now to FIG. 7, the support segment 22 is shown in more detail. The support segment 22 includes a first segment 24 and a second segment 26 extending therefrom. The first segment 24 includes an arcuate portion 28, configured to receive a correspondingly arcuate portion of the rails 14*a*, 14*b*.

Referring again to FIG. 7, the arcuate portion 28 has a radius R1. The radius R1 is configured to receive a portion of a rail 14*a*, 14*b* having a corresponding arcuate radius. In the illustrated embodiment, the radius R1 is in a range of from about 50.0 mm to about 70.0 mm. In alternate embodiments, the radius R1 can be less than about 50.0 mm or more than about 70.0 mm, sufficient to receive a portion of the rails 14*a*, 14*b* having a corresponding arcuate radius.

Referring again to FIG. 7, the first segment 24 of the support segment 22 has a width W1. The width W1 is configured to be less than a width of each of the rails 14*a*, 14*b* such as to avoid points of interference with a user positioned between the rails 14*a*, 14*b*. In the illustrated embodiment, the width W1 is in a range of from about 20.0 mm to about 40.0 mm. However, in other embodiments, the width W1 can be less than about 20.0 mm or more than about 40.0 mm, sufficient to avoid points of interference with a user positioned between the rails 14*a*, 14*b*.

Referring again to FIG. 7, the second segment 26 extends from the first segment 24 and is configured for insertion into an upper end of the riser segments 20*a*-20*d*. The second segment 26 has a smaller cross-sectional profile than the first segment 24, thereby creating a circumferential shoulder 30. The circumferential shoulder 30 is configured to seat against the upper end of a riser segment 20*a*-20*d* as the second segment 26 is positioned within the riser segment 20*a*-20*d*.

Referring now to FIGS. 1, 2 and 7, the second segment 26 of the support segment 22 includes an aperture 32. The aperture 32 is configured to receive mounting hardware 34 extending through a corresponding aperture (not shown) in a riser segment 20*a*-20*d*, thereby fastening the support segment 22 to the riser segment 20*a*-20*d*. In the illustrated embodiment, the mounting hardware 34 includes a threaded fastener and a hex head nut. In other embodiments, the mounting hardware 34 can include other structures, mechanisms and devices, such as the non-limiting examples of clips, clamps and the like, sufficient to fastening the support segment 22 to the riser segment 20*a*-20*d*.

Figure 8:
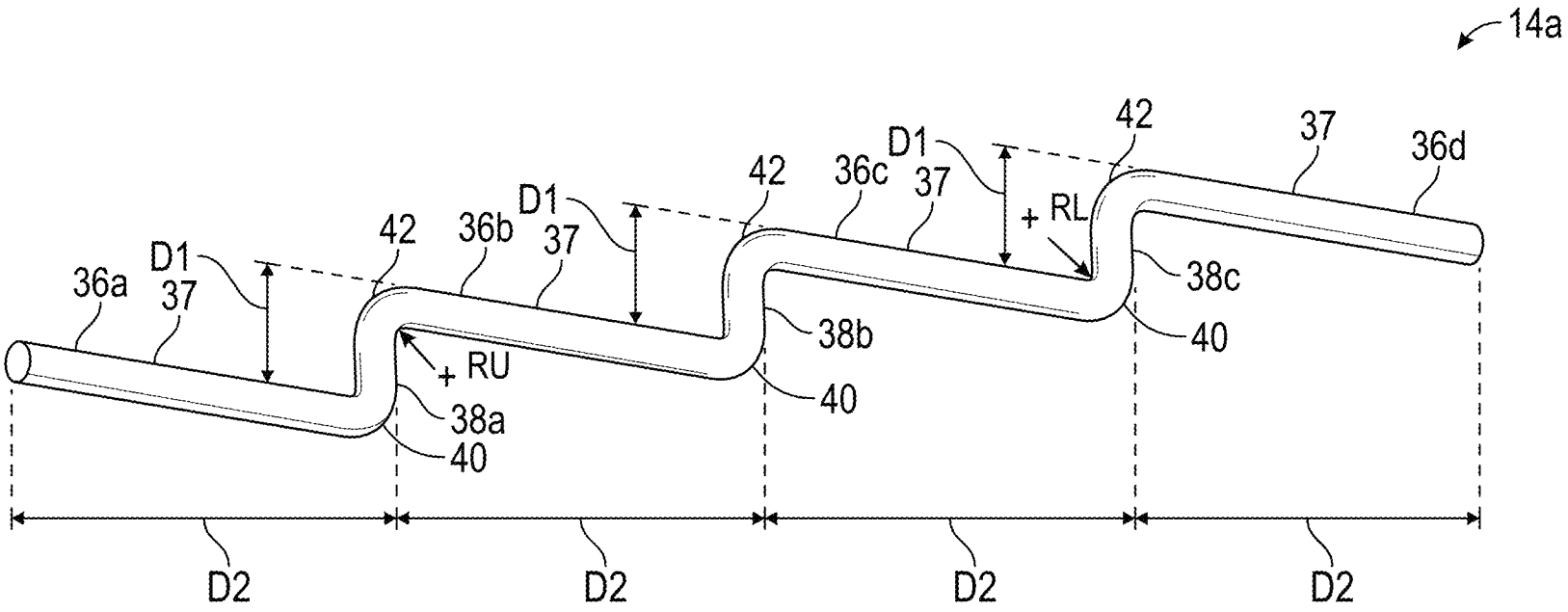
FIG. 8 is a side view of a rail of the exercise apparatus of FIG. 1.

Referring now to FIG. 8, the rail 14*a* is illustrated. The rail 14*a* is representative of the rail 14*b*. The rail 14*a* includes a plurality of generally horizontal segments 36*a*-36*d* and generally vertical segments 38*a*-38*c* interspersed therebetween. In the illustrated embodiment, the horizontal and vertical segments 36*a*-36*d*, 38*a*-38*c* form the rail 14*a* as a unitary, continuous structure and are formed from a tubular metallic material such as the non-limiting example of ASTM 4140, having a cross-sectional of 40.0 mm and a wall thickness of 6.0 mm. However, in other embodiments, the horizontal and vertical segments 36*a*-36*d*, 38*a*-38*c* can be discrete elements that are connected together to form the rail 14*a* and can be made from other suitable materials including the non-limiting example of reinforced structural fiberglass.

Referring now to FIG. 8, an upper surface of adjacent horizontal segments 36*a*-36*d* is spaced apart a distance D1. The distance D1 is configured as an optimal rise between adjacent horizontal segments 36*a*-36*d* for a user traversing the length of the rails 14*a*, 14*b* to develop improved strength, stamina, flexibility and coordination. In the illustrated embodiment, the distance D1 is in a range of from about 4.0 to about 5.0 inches. However, it should be appreciated that the distance D1 can be less than about 4.0 inches in order to make the transition between adjacent horizontal segments 36*a*-36*d* easier or the distance D1 can be more than about 5.0 inches in order to make the transition between adjacent horizontal segments 36*a*-36*d* more difficult to develop improved strength, stamina, flexibility and coordination. While the embodiment shown in FIG. 8 illustrates all the distances D1 as being the same, it should be appreciated that in other embodiments, the distances D1 between adjacent horizontal segments 36*a*-36*d* can be different from each other.

Referring again to FIG. 8, each of the horizontal segments 36*a*-36*d* has a horizontal length D2. The horizontal length D2 is configured to allow a user to have multiple hand movements on the same horizontal segment 36*a*-36*d* prior to transitioning to an adjacent horizontal segment 36*a*-36*d* to develop improved strength, stamina, flexibility and coordination. In the illustrated embodiment, the horizontal length D2 is in a range of from about 14.0 to about 18.0 inches. However, it should be appreciated that the horizontal length D2 can be less than about 14.0 inches in order to make the transition between adjacent horizontal segments 36*a*-36*d* shorter or the horizontal length D2 can be more than about 18.0 inches in order to make the transition between adjacent horizontal segments 36*a*-36*d* longer. While the embodiment shown in FIG. 8 illustrates all horizontal length D2 as being the same, it should be appreciated that in other embodiments, the horizontal length D2 between adjacent horizontal segments 36*a*-36*d* can be different from each other.

Referring again to FIG. 8, in use an upper surface of the horizontal segments 36*a*-36*d* of each rail 14*a*, 14*b* is grasped by the user's hands as the user traverses the exercise apparatus 10. To assist in a secure grip of the rails 14*a*, 14*b*, optionally the upper surface of the horizontal segments 36*a*-36*d* can include a plurality of surface structures 37. The term "surface structure", as used herein, is defined to mean any structure or treatment located on or extending from a surface. The surface structures 37 are configured to minimize slippage of the user's hands during use of the exercise apparatus 10.

Figure 9:
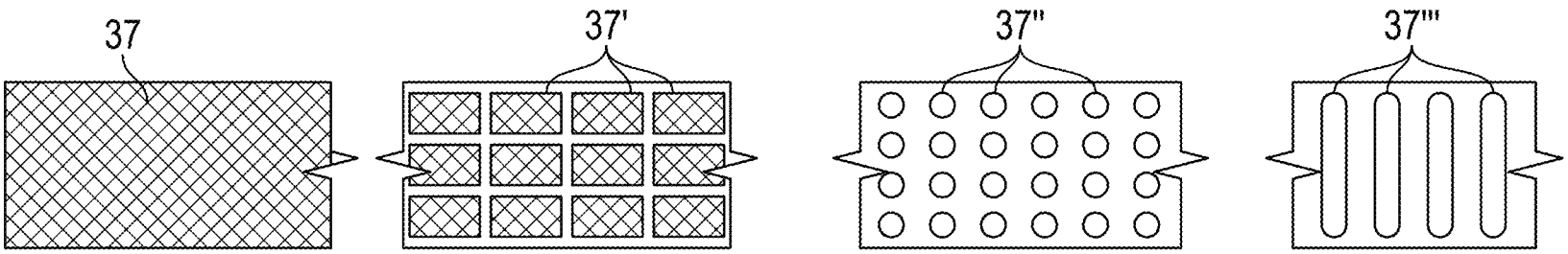
FIG. 9 is a plan view of several embodiments of a surface structure of the rail of FIG. 8.

Referring now to FIG. 9, non-limiting examples of optional surface structures are illustrated. In a first example, the surface structures 37 have the form of a knurled surface. The term "knurled surface", as used herein, is defined to mean a series of intersecting cross hatchings forming raised ridges or projections.

Referring again to FIG. 9, the surface structures 37 extend continuously across the upper surface of the horizontal segments 36*a*-36*d*. In other embodiments, the surface structures 37 can be any desired pattern of discontinuous segments and the surface structures 37 can extend any desired distance across the upper surface of the horizontal segments 36*a*-36*d*.

A second non-limiting example of discontinuous segments of surface structures 37 is shown in FIG. 9. In this embodiment, a plurality of surface structure segments 37' is arranged in rows and columns across the upper surface of the horizontal segments 36*a*-36*d* with each of the surface structure segments 37' having the knurled surface. The surface structure segments 37' can be arranged in any desired pattern and can have any desired surface structure.

While the surface structures 37, 37' have been described above as a knurled surface, it should be appreciated that the surface structures 37 can have other forms, sufficient to minimize slippage of the user's hands during use of the exercise apparatus 10. Referring again to FIG. 9 in a third example, the surface structures 37" are illustrated. The surface structures 37" have the form of a plurality of nibs. The term "nib", as used herein, is defined to mean any structure having a substantially protruding extremity.

The nibs forming the surface structures 37" are arranged in rows and columns. However, the surface structures 37" can be arranged in any desired pattern sufficient to minimize slippage of the user's hands during use of the exercise apparatus 10.

In the third embodiment illustrated in FIG. 9, the surface structures 37" have a circular cross-sectional shape and the rows and columns extend continuously across the upper surface of the horizontal segments 36*a*-36*d*, however any desired cross-sectional shape of the surface structures 37" can be used and the surface structures 37" can be arranged in discontinuous rows and column across any desired distance of the upper surface of the horizontal segments 36*a*-36*d*. While the surface structures 37" are shown as substantially identical "nibs", it should be appreciated that the surface structures 37" can be different from each other.

Referring again to FIG. 9, a fourth non-limiting embodiment of a surface structure is illustrated at 37'". The surface structures 37'" are formed as spaced apart ridges that extend transversely across a width of the upper surface of the horizontal segments 36*a*-36*d*. The surface structures 37'" are arranged in a single row. However, the surface structures 37'" can be arranged in any desired pattern sufficient to minimize slippage of the user's hands during use of the exercise apparatus 10.

Referring again to FIG. 9, the surface structures 37, 37', 37" and 37'" are configured to extend from the upper surface of the horizontal segments 36*a*-36*d* a height such that the surface structures can engage the hands of the user. In the illustrated embodiment, the height is in a range of from about 1.0 mm to about 2.0 mm. In other embodiments, the height can be less than about 1.0 mm or more than about 2.0 mm sufficient that the surface structures 37, 37', 37" and 37'" can engage the hands of the user.

While the surface structures 37, 37', 37" and 37'" are described above as structures formed integral to the upper surfaces of the horizontal segments 36*a*-36*d*, it is within the contemplation of this invention that one or more surface structures can be applied to or attached to the upper surfaces of the horizontal segments 36*a*-36*d*. One example of applied surface structures includes an applied coating and/or layer of a substantially abrasive material or grit, such as for example, silica, iron oxide, aluminum oxide or polymeric materials. Another non-limiting example of an applied surface structure includes a non-slip polymeric material. The applied surface structure can be attached to the upper surfaces of the horizontal segments 36*a*-36*d* in any desired manner, including, for example, adhesives or sonic welding.

Referring again to FIG. 8, each of the vertical segments 38*a*-38*c* includes a lower radiused portion 40 and an upper radiused portion 42. The lower radiused portion 40 is configured as a transition from a horizontal segment to a vertical segment and has a radius RL. The upper radiused portion 42 is configured as a transition from a vertical segment to a horizontal segment and has a radius RU. In the illustrated embodiment, the radii RL and RU are in a range of from about 50.0 mm to about 70.0 mm. In alternate embodiments, the radii RL and RU can be less than about 50.0 mm or more than about 70.0 mm, sufficient for transitioning between adjacent rail segments. In the embodiment illustrated in FIG. 8, the radii RL and RU are shown as being the same. However, it should be appreciated that in other embodiments, the radii RL and RU can be different from each other, thereby providing different transitions between adjacent rail segments.

Referring now to FIGS. 7 and 8, the lower radiused portion 40 has an arcuate outer surface, which is configured to seat in the corresponding arcuate portion 28 of a support segment 22.

Figure 3:
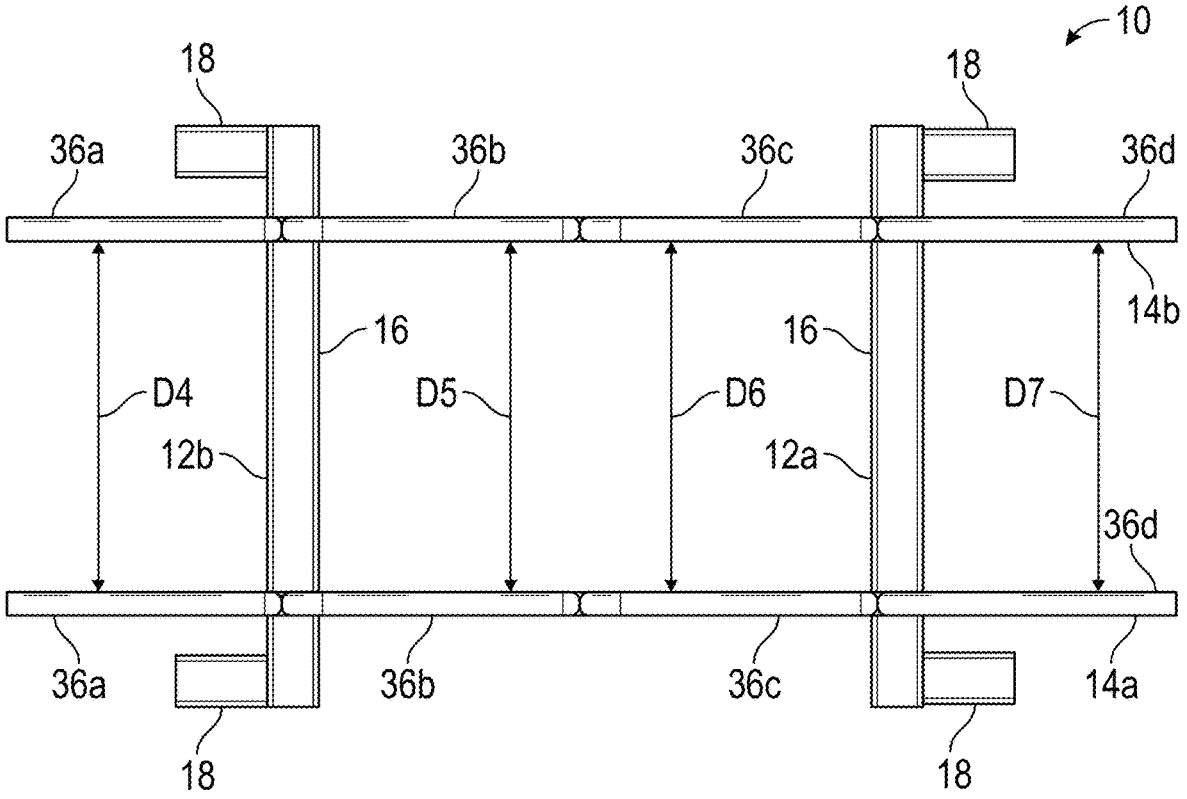
FIG. 3 is a plan view of the exercise apparatus of FIG. 1.
Figure 4:
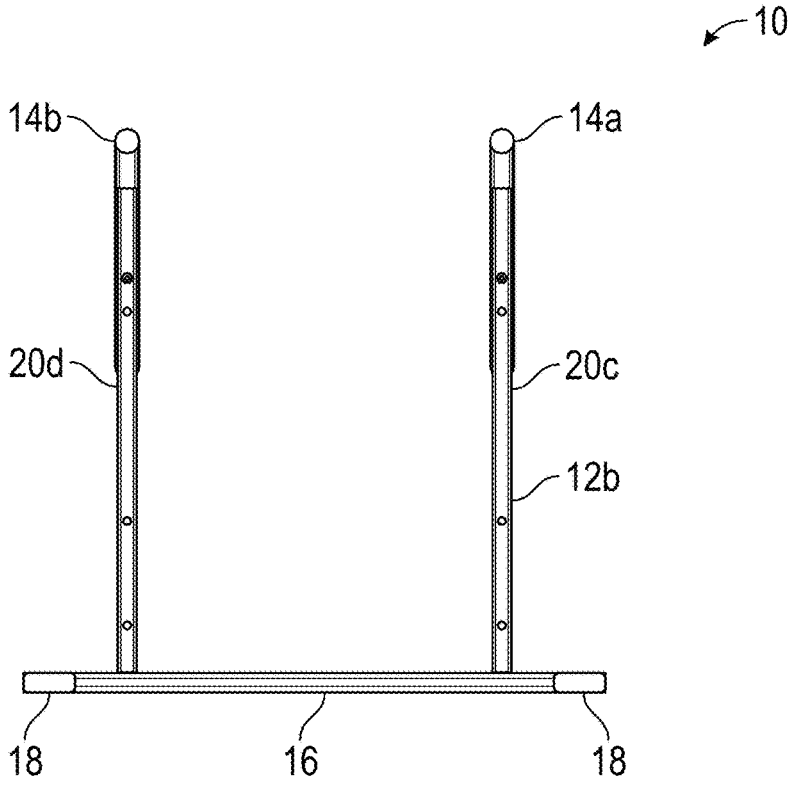
FIG. 4 is a front view of the exercise apparatus of FIG. 1.
Figure 5:
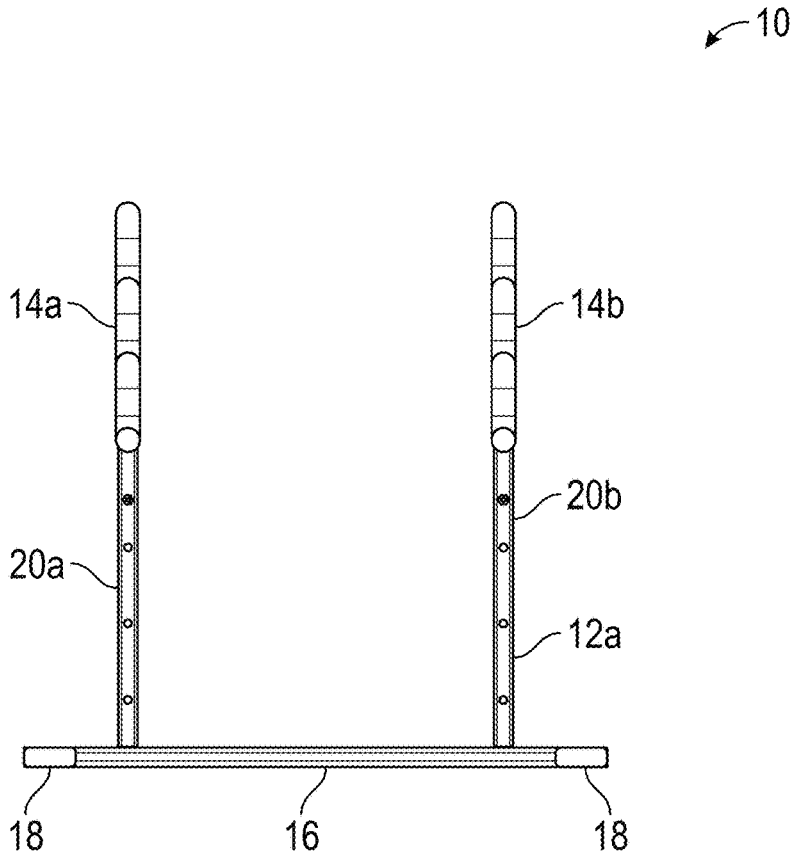
FIG. 5 is a rear view of the exercise apparatus of FIG. 1.

Referring now to FIG. 3, a plan view of the exercise apparatus 10 is illustrated. The exercise apparatus 10 includes the rails 14*a*, 14*b*, with each of the rails 14*a*, 14*a* having the horizontal portions 36*a*-36*d*. Horizontal portions 36*a* of the rails 14*a*, 14*b* are separated by a distance D4. In a similar manner, horizontal portions 36*b* are separated by a distance D5, horizontal portions 36*c* are separated by a distance D6 and horizontal portions 36*d* are separated by a distance D7. In the illustrated embodiment, the distance D4-D7 are the same as each other and are configured to provide a uniform width between the rails 14*a*, 14*b*. In the illustrated embodiment, the distances D4-D7 are in a range of from about 15.0 inches to about 30.0 inches. However, in other embodiment, the distances D4-D7 can be less than about 15.0 inches or more than about 30.0 inches.

Figure 10:
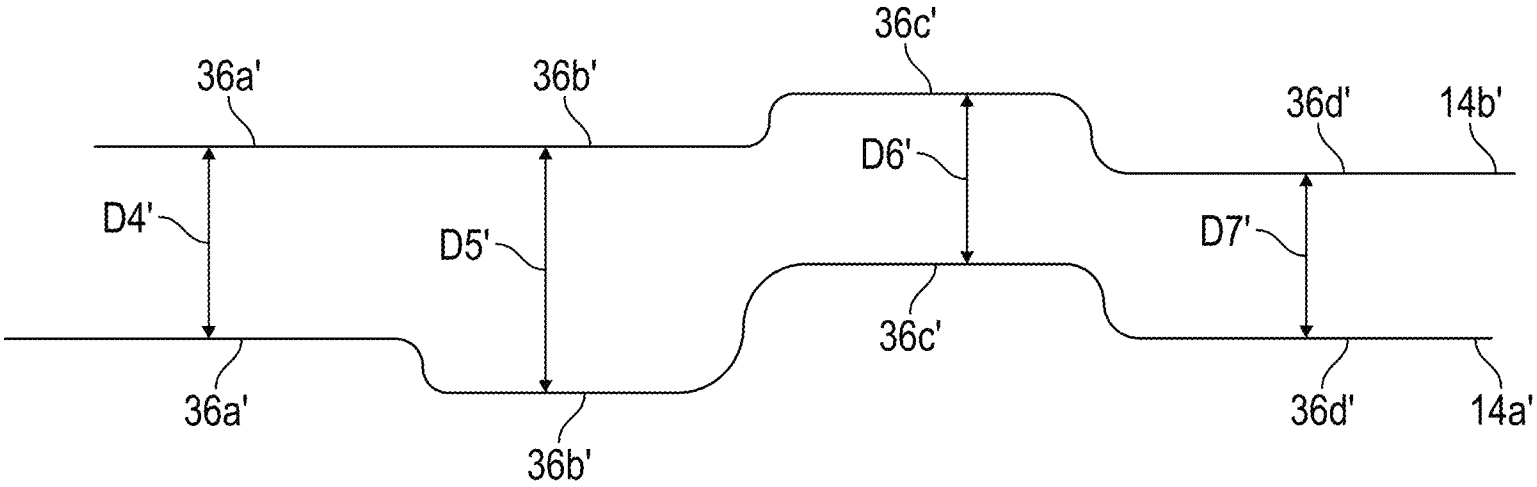
FIG. 10 is a plan view of an alternate embodiment of the opposing rails of the exercise apparatus of FIG. 1.

In certain embodiments, it is contemplated that the distance between the horizontal portions 36*a*-36*d* of the rails 14*a*, 14*b* need not be consistent. In these instances, it is believed varying distance between the horizontal portions 36*a*-36*d* of the rails 14*a*, 14*b* can be used to develop improved strength, stamina, flexibility and coordination of the user. Referring now to FIG. 10, a top view of rails 14*a*', 14*b*' is shown with each of the rails 14*a*', 14*b*' having opposed horizontal portions 36*a*'-36*d*'. The opposing horizontal portions 36*a*' forming a distance D4'. In a similar manner, the opposing horizontal portions 36*b*' forming a distance D5', the opposing horizontal portions 36*c*' forming a distance D6' and the opposing horizontal portions 36*d*' forming a distance D7'. The distances D4'-D7' can be any combination of the same as each other or different from each other.

While the horizontal portions 36*a*-36*d* of each of the rails shown in FIG. 3 are axially aligned, it should be appreciated that in other embodiments the horizontal portions of each of the rails need not be axially aligned, as shown in FIG. 10. Without being held to the theory, it is believed varying the axial alignment of the horizontal portions 36*a*-36*d* of the rails 14*a*', 14*b*' can be used to develop improved strength, stamina, flexibility and coordination of the user.

Figure 11:
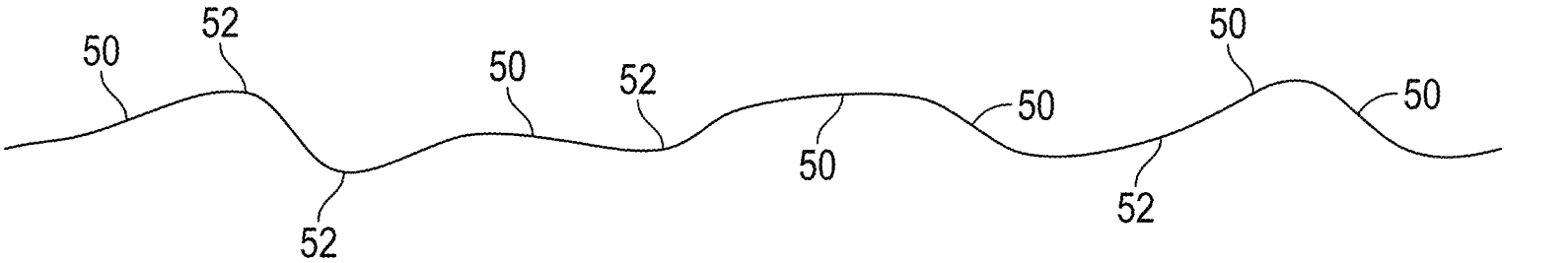
FIG. 11 is a side view of an alternate embodiment of a rail of the exercise apparatus of FIG. 1.

Referring again to FIG. 8, each of the rails 14*a*, 14*b* includes horizontal portions 36*a*-36*d* and vertical portions 38*a*-38*c*. In another embodiment, it is contemplated that the rails 14*a*, 14*b* can have sloped and/or arcuate portions to develop improved strength, stamina, flexibility and coordination. Referring now to FIG. 11, the alternate rail 14*a*" is illustrated. The alternate rail 14*a*" is representative of an opposing rail 14*b*". The alternate rail 14*a*" has a combination of sloped portions 50 and arcuate portions 52. It should be appreciated that any desired combination of sloped portions 50 and/or arcuate portions 52 can be used. It should also be appreciated that the sloped portions 50 and the arcuate portions 52 of the opposing rails may align or maybe misaligned, that is, the sloped portion 50 of a first rail may oppose a sloped portion of the second rail or an arcuate portion of the second rail.

Figure 12:
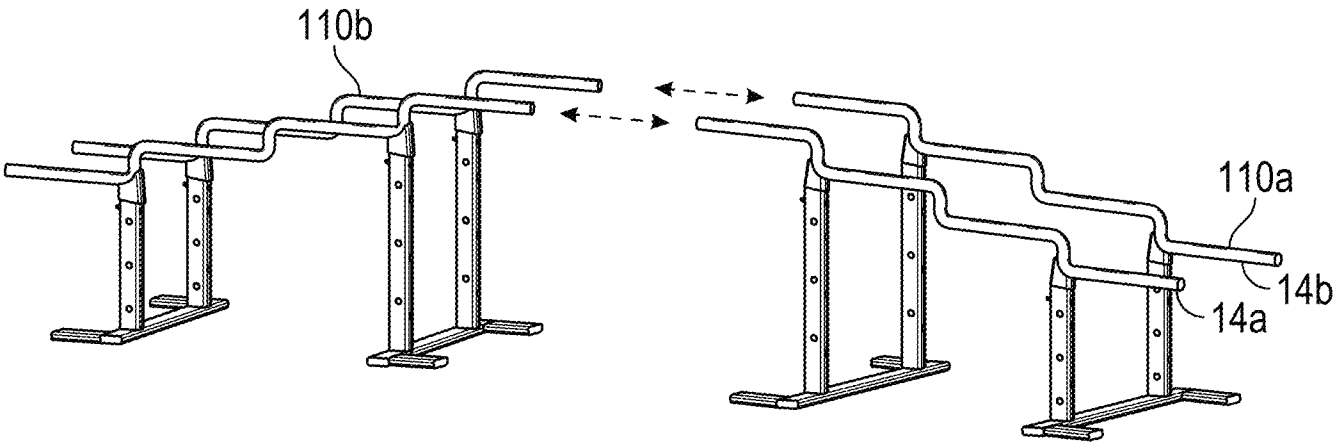
FIG. 12 is a perspective view of a first embodiment of adjoining exercise apparatus of FIG. 1.
Figure 13:
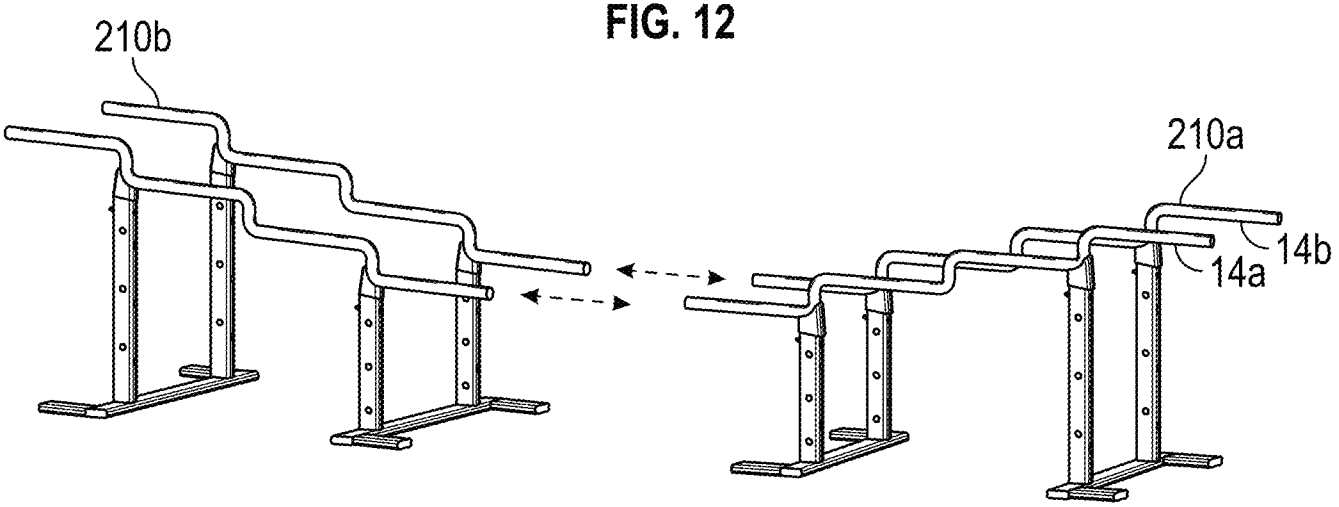
FIG. 13 is a perspective view of a first embodiment of adjoining exercise apparatus of FIG. 1.

Referring now to FIGS. 12 and 13, it is further contemplated that in other embodiments, more than one exercise apparatus can be joined together, thereby extending the exercise routine over a longer length of the joined rails. Referring first to FIG. 12, exercise apparatus 110*a* and 110*b* are joined together at an upper end of the rails 14*a*, 14*b*. Referring now to FIG. 13, exercise apparatus 210*a* and 210*b* are joined together at a lower end of the rails 14*a*, 14*b*. Any desired structure, device or mechanism can be used to join a rail of one exercise apparatus with a corresponding rail of another exercise apparatus. It should be appreciated that any desired quantity of exercise apparatus can be joined together to develop improved strength, stamina, flexibility and coordination. Since any desired quantity of exercise apparatus can be joined together, it should be appreciated that the resulting structure can have any desired length.

It is further contemplated that in other embodiments, other exercise-related structures and equipment can be joined to one or more exercise apparatus. One non-limiting example of other exercise-related structures and equipment is a pommel horse.

In accordance with the provisions of the patent statutes, the principle and mode of operation of the exercise apparatus have been explained and illustrated in certain embodiments. However, it must be understood that the exercise apparatus may be practiced otherwise than as specifically explained and illustrated without departing from its spirit or scope.

What is claimed is:

1. An exercise apparatus configured for exercises and exercise routines to develop improved strength, stamina, flexibility and coordination of a user, the exercise apparatus comprising:

a first base assembly having a plurality of riser segments, each of the riser segments including a support segment, each of the support segments having a radiused arcuate portion;

a second base assembly spaced apart from the first base assembly and having a plurality of riser segments, each of the riser segments including a support segment, each of the support segments having a radiused arcuate portion;

a first rail spanning the first and second base assemblies, the first rail having a plurality of horizontal segments interspersed with a plurality of vertical segments, wherein an associated radiused arcuate portion of the first and second base assemblies is connected to an associated vertical segment of the first rail such that a longitudinal axis of an associated riser segment aligns with a longitudinal axis of the associated vertical segment; and a second rail spaced apart from the first rail and spanning the first and second base assemblies, the second rail having a plurality of horizontal segments interspersed with a plurality of vertical segments, wherein an associated radiused arcuate portion of the first and second base assemblies is connected to an associated vertical segment of the second rail such that a longitudinal axis of an associated riser segment aligns with a longitudinal axis of the associated vertical segment;

wherein adjacent horizontal segments of each of the first and second rails are vertically spaced apart.

2. The exercise apparatus of claim 1, wherein the horizontal and vertical segments of the second rail correspond to the horizontal and vertical segments of the first rail.

3. The exercise apparatus of claim 2, wherein the corresponding horizontal and vertical segments of the first and second rails are spaced apart by different horizontal distances.

4. The exercise apparatus of claim 1, wherein one end of the first rail is vertically spaced apart from a second end of the first rail.

5. The exercise apparatus of claim 1, wherein each of the riser segments of the first and second base assemblies include an arcuate portion configured to receive a lower radiused portion of one of the first or second rails.

6. The exercise apparatus of claim 1, wherein an upper surface of the horizontal segments of the first and second rails includes a plurality of surface structures.

7. The exercise apparatus of claim 1, wherein the first and second rails of the exercise apparatus can be joined with first and second rails of an adjoining exercise apparatus, thereby extending the exercises and exercise routines over a longer length of the joined rails.

8. An exercise apparatus configured for exercises and exercise routines to develop improved strength, stamina, flexibility and coordination of a user, the exercise apparatus comprising:

a first base assembly having a plurality of riser segments, each of the riser segments including a support segment, each of the support segments having a radiused arcuate portion;

a second base assembly spaced apart from the first base assembly and having a plurality of riser segments, each of the riser segments including a support segment, each of the support segments having a radiused arcuate portion;

a first rail connected to and spanning the first and second base assemblies, the first rail having a length and a plurality of sloped portions interspersed with a plurality of arcuate portions; and a second rail spaced apart from the first rail and connected to and spanning the first and second base assemblies, the second rail having a length and a plurality of sloped portions interspersed with a plurality of arcuate portions;

wherein the sloped portions and the arcuate portions constitute the lengths of the first and second rails.

9. The exercise apparatus of claim 8, wherein the sloped portions and arcuate portions of the second rail correspond to the sloped portions and arcuate portions of the first rail.

10. The exercise apparatus of claim 8, wherein the corresponding sloped portions and arcuate portions of the first and second rails are spaced apart by different horizontal distances.

11. The exercise apparatus of claim 8, wherein one end of the first rail is vertically spaced apart from a second end of the first rail.

12. The exercise apparatus of claim 8, wherein each of the riser segments of the first and second base assemblies include an arcuate portion configured to receive a lower radiused portion of one of the first or second rails.

13. The exercise apparatus of claim 8, wherein an upper surface of the sloped portions or arcuate portions of the first and second rails includes a plurality of surface structures.

14. The exercise apparatus of claim 8, wherein the first and second rails of the exercise apparatus can be joined with first and second rails of an adjoining exercise apparatus, thereby extending the exercises and exercise routines over a longer length of the joined rails.

15. A method of forming an exercise apparatus for exercises and exercise routines to develop improved strength, stamina, flexibility and coordination of a user, the method comprising the steps of:

forming a first base assembly with a plurality of riser segments, each of the riser segments including a support segment, each of the support segments having a radiused arcuate portion;

forming a second base assembly spaced apart from the first base assembly and having a plurality of riser segments, each of the riser segments including a support segment, each of the support segments having a radiused arcuate portion;

forming a first rail with a plurality of horizontal segments interspersed with a plurality of vertical segments, wherein adjacent horizontal segments of the first rail are spaced apart by a vertical distance;

connecting certain of the vertical segments of the first rail to the radiused arcuate portions of an associated support segment of each of the first and second base assemblies in a manner such that a longitudinal axis of each of the riser segments aligns with a longitudinal axis of the connected vertical segments; and forming a second rail with a plurality of horizontal segments interspersed with a plurality of vertical segments, wherein adjacent horizontal segments of the second rail are spaced apart by a vertical distance; and connecting certain of the vertical segments of the second rail to the radiused arcuate portions of an associated support segment of each of the first and second base assemblies in a manner such that a longitudinal axis of each of the riser segments aligns with a longitudinal axis of the connected vertical segments.

16. The method of claim 15, including the step of aligning the horizontal and vertical segments of the second rail with the horizontal and vertical segments of the first rail.

17. The method of claim 16, including the step of forming the aligned horizontal and vertical segments of the first and second rails to be spaced apart by different horizontal distances.

18. The method of claim 15, including the step of forming the first rail with one end vertically spaced apart from a second end of the first rail.

19. The method of claim 15, including the step of forming a plurality of surface structures on an upper surface of the horizontal segments of the first and second rails.

20. The method of claim 15, including the step of joining the first and second rails of the exercise apparatus with first and second rails of an adjoining exercise apparatus, thereby extending the exercises and exercise routines over a longer length of the joined rails.

* * * * *